United States Patent [19]

Tolnar, Jr. et al.

[11] 4,010,998

[45] Mar. 8, 1977

[54] MATABLE ELECTRICAL CONNECTOR MEANS WITH INERTIA LOCK

[75] Inventors: Emil J. Tolnar, Jr., Warren; Robert G. Plyler, Vienna; David R. Heilman, Warren, all of Ohio

[73] Assignee: General Motors Corporation, Detroit, Mich.

[22] Filed: Jan. 26, 1976

[21] Appl. No.: 652,387

[52] U.S. Cl. ..... 339/91 R

[51] Int. Cl.[2] ..... H01R 13/54

[58] Field of Search ..... 339/75 R, 75 M, 91 R

[56] References Cited

UNITED STATES PATENTS

| | | | |
|---|---|---|---|
| 3,869,191 | 3/1975 | Tolnar et al. | 339/91 R X |
| 3,933,406 | 1/1976 | Cameron et al. | 339/91 R |

*Primary Examiner*—Roy Lake
*Assistant Examiner*—E. F. Desmond
*Attorney, Agent, or Firm*—F. J. Fodale

[57] ABSTRACT

Matable electrical connector means having an "inertia" lock with a self-reject feature comprise first and second connector bodies respectively retaining matable male and female terminals having a predetermined terminal engage force. The connector bodies include a deflectable latch arm and generally triangular lock ramp respectively which cooperate to lock the connector bodies together and retain the terminals in a fully mated position. During assembly, the latch arms are deflected outwardly, by the leading portion of the triangular ramps producing a force which resists connection of the connector bodies. This latter resistance force reaches a maximum magnitude of about twice the terminal engage force when the latch arms engage the peaks of the ramps. The terminals do not engage in a way which produces any appreciable resistance force prior to the latch arms passing the peaks whereupon the latch arms produce a force assisting locking of the connector bodies together.

5 Claims, 8 Drawing Figures

MATABLE ELECTRICAL CONNECTOR MEANS WITH INERTIA LOCK

This invention relates generally to matable electrical connector means and more specifically to matable electrical connector means including connector bodies having lock means for retaining the connector bodies in a mated position.

Lock means comprising at least one latch arm of one connector body which cooperates with a ramp lock on the other connector body to lock the connector bodies together with the terminals in fully mated engagement are well known in the art. See for instance U.S. Pat. No. 3,651,446 to Walter C. Sadogierski et al. dated Mar. 21, 1972 and U.S. Pat. No. 3,605,070 to Kerry M. Krafthefer dated Sept. 14, 1971.

As far as we are aware, however, all lock means of the type mentioned above have always had the characteristic that the matable terminals carried by the connector bodies matingly engaged during the time that the locking means were producing high forces resisting mating of the connector bodies. Consequently mating forces sufficient to overcome the resistance of the terminal engage forces as well as the maximum locking means resistance forces were required to lock the connector bodies together and fully mate the terminals.

It is also well known to incorporate a self-reject feature in lock means of the type mentioned above which pushes the connector bodies apart in the event a force insufficient to lock the connector bodies together is applied. A self-reject feature is incorporated by choosing an angle for the ramp which deflects the latch arm outwardly during mating which angle in relation to the stiffness of the lock arm is such that the longitudinal force resisting engagement produced by the latch arm and ramp is about twice the resistance force produced by mating engagement of the terminals. Thus if the terminals are not fully engaged, the connector bodies are pushed apart by the energy stored in the latch arm and no electrical connection is made.

The object of the present invention is to provide matable electrical connector means with "inertia" lock means which require a minimum engage force while retaining a self-reject feature in the event that a manually applied engage force of insufficient magnitude is applied.

By an "inertia" lock means, we mean that once a manually applied engage force of sufficient magnitude is manually applied, the connector engage motion cannot readily be stopped until the connector bodies are locked and the terminals carried thereby are fully engaged. On the other hand if the manually applied connector engage force is not of sufficient magnitude, the connectors will self-reject because of the retention of this feature. Thus when the matable connectors are manually connected, if the operator applies a force sufficient to overcome the self-reject feature, the connector bodies are necessarily locked together with the terminals fully mated. If not, the connector bodies self-reject when the operator lets go of the connector bodies and an unlocked and partially engaged terminal condition is avoided. The engage force is minimized by incorporating the lock means in such a way that the maximum force of the lock means resisting connection occurs prior to any appreciable resistance to connection produced by mating engagement of the terminals. The above combination of features is highly desirable in an assembly line operation where a connector body at the end of a wiring harness is manually coupled to a mating connector body on a panel or another wiring harness already in place.

Another feature which may be incorporated into matable electrical connectors in accordance with this invention is the provision of lock means which during assembly of the connector bodies produce forces which assist connection at the inception of the terminal engage forces resisting connection.

Other objects and features of the invention will become apparent to those skilled in the art as the disclosure is made in the following detailed description of a preferred embodiment of the invention as illustrated in the accompanying sheets of drawing in which.

Figure 1:
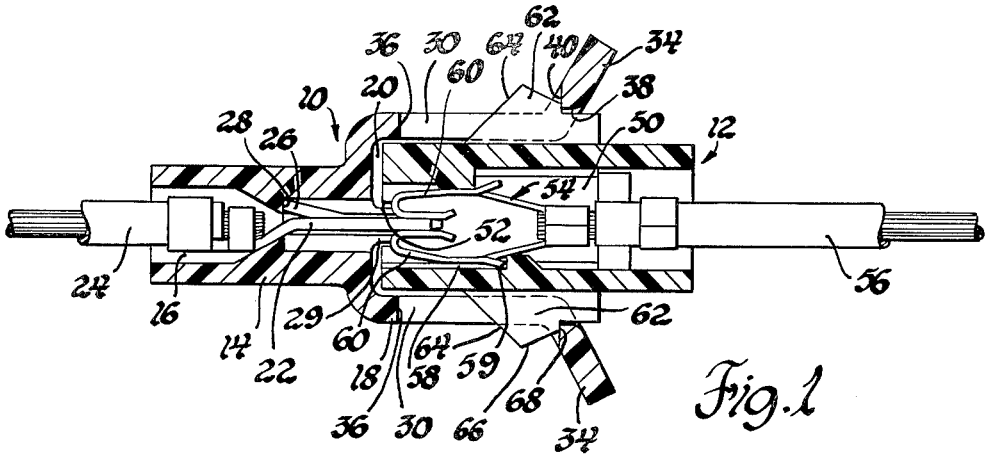
FIG. 1 is a partially sectioned side view of electrical connector means in accordance with this invention illustrated in a mated and locked position.
Figure 4A:
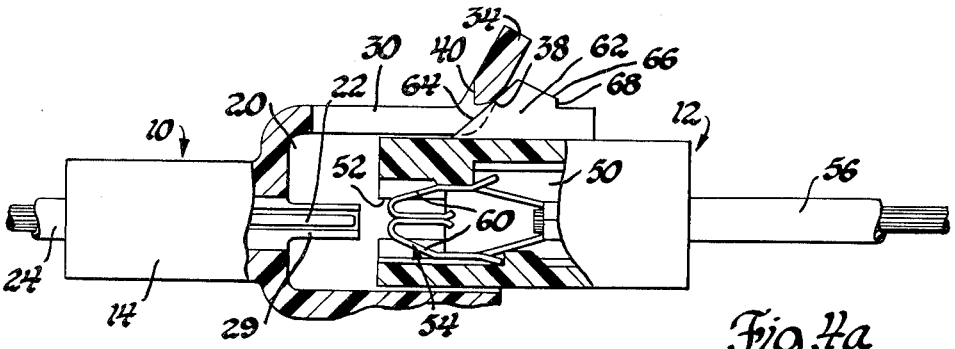
Figure 4B:
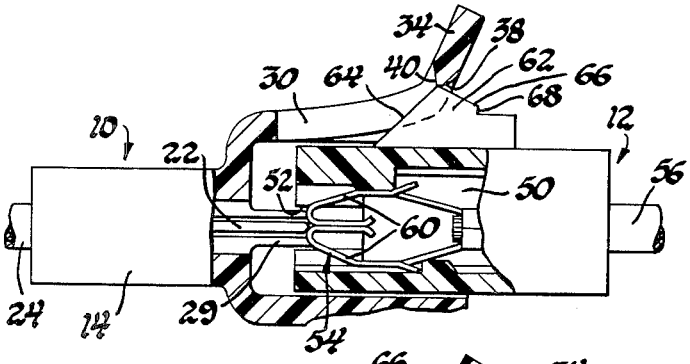
Figure 4C:
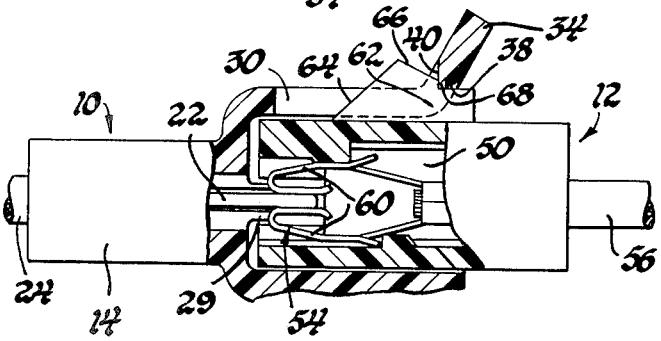
Figure 5A:
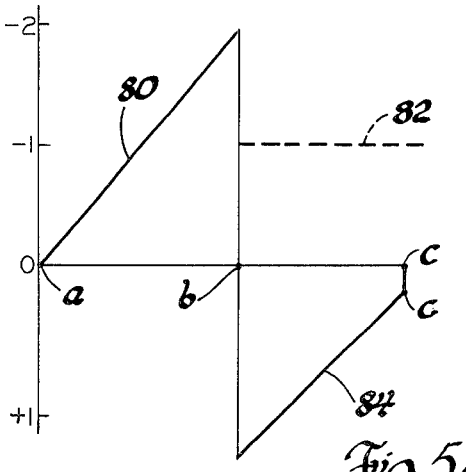
Figure 5B:
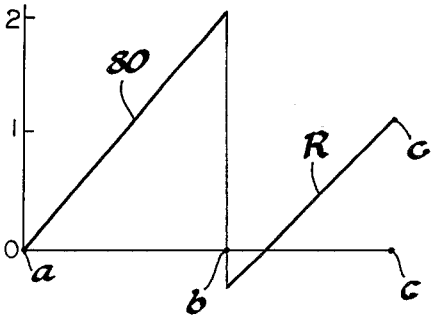

FIGS. 4*a*, 4*b* and 4*c* are partially sectioned side views similar to FIG. 1 showing the electrical connector means in progressive stages of assembly into mated and locked engagement;

FIGS. 5*a* and 5*b* are graphs showing various forces encountered during assembly of the electrical connector means into mated and locked engagement.

Figure 2:
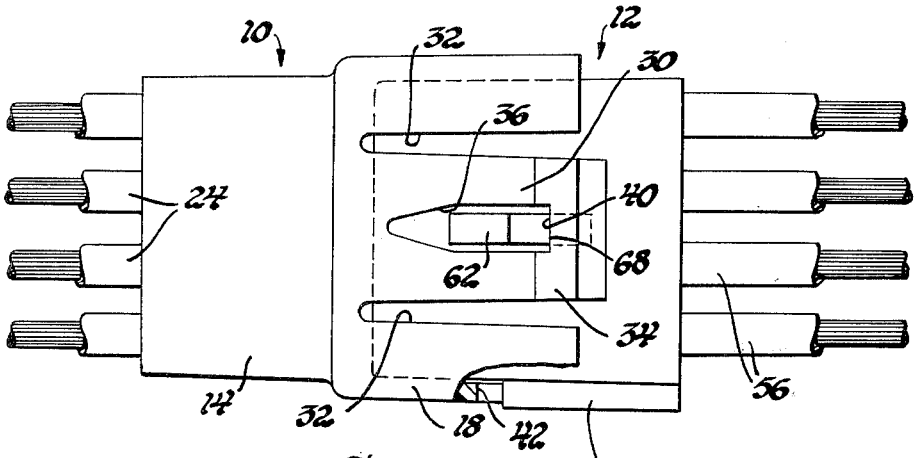
FIG. 2 is a top view of the mated and locked electrical connector means shown in FIG. 1.
Figure 3:
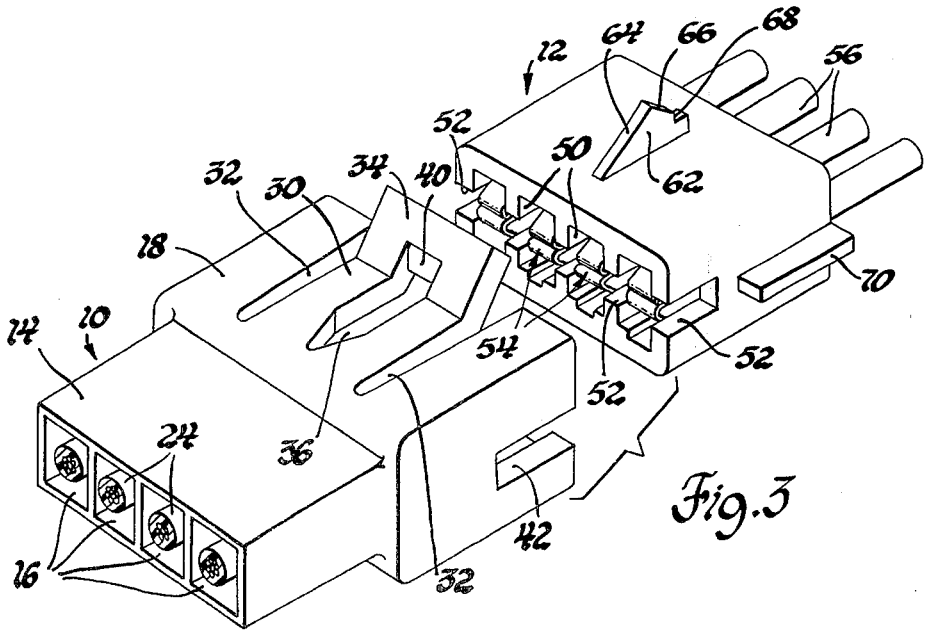
FIG. 3 is a perspective view showing the electrical connector means of FIGS. 1 and 2 in a disconnected position.

Referring now to the drawing and more particularly to FIGS. 1, 2 and 3, there is shown electrical connector means comprising a matable pair of connector bodies 10 and 12 of moldable insulating material such as polypropylene.

The connector body 10 has a rearward portion 14 with a plurality of longitudinal open ended terminal receiving cavities 16. The connector body 10 has an enlarged forward socket portion 18 defining a transverse slot 20 which communicates with the forward open ends of the cavities 16. A male blade terminal 22 connected to a lead wire 24 in a conventional manner is inserted into the rearward open end of each of the cavities 16 and retained therein by a spring finger 26 of the male blade terminal 22 engaging an internal shoulder 28 of the cavity 16. In the retained position the forward end of the male terminal 22 protrudes into the transverse slot 20 with its edges confined in longitudinal slots in narrow extensions 29 at the sides of the cavities 16 which also protrude a short distance into the transverse slot 20.

The top and bottom walls of the socket portion 18 each have an integral cantilevered latch arm 30 separated from its respective wall by longitudinal slots 32. Each latch arm 30 has an angled free end 34 and central slot 36. The mid portion of the free end 34 in line with the central slot 36 has an inner end surface comprising a forward curved surface 38 leading to a rearward vertical surface 40. One side wall of the forward socket portion 18 has a longitudinal polarizing slot 42.

The connector body 12 has a plurality of longitudinal open ended terminal receiving cavities 50. The partition walls between the cavities and the side walls of the connector body 12 have longitudinal slots 52 at their forward ends. The longitudinal slots 52 receive narrow extensions 29 of the connector body 10 when the connector bodies 10 and 12 are mated.

A female terminal 54 connected to a lead wire 56 in a conventional manner is inserted into the rearward open end of each of the cavities 50 and retained therein by a resilient finger 58 cooperating with an internal latch shoulder 59. The female terminals 54 have upper and lower U-shaped cantilevered spring fingers 60. Each of the male blade terminals 22 is received between the spring fingers 60 of one of the female terminals 54 and resiliently engaged thereby.

The top and bottom walls of the connector body 12 each have a generally triangular shaped locking ramp 62 having a forward outwardly and rearwardly sloping cam surface 64 for deflecting the latch arms 30 outwardly during assembly of the connector bodies 10 and 12 into mated engagement and an inwardly and rearwardly sloping trailing surface 66 leading to a rearward vertical surface 68 which cooperates with a respective vertical surface 40 of the latch arms 30 to lock the connector bodies 10 and 12 in mated engagement. When mated, a boss 70 protruding laterally from a side wall of the connector body 12 is received in the polarizing slot 42 so that the terminals 22 and 60 are mated as intended.

Referring now to FIGS. 4*a*, 4*b*, 4*c*, 5*a* and 5*b*, the novel lock means of this invention will be explained in detail.

FIG. 4*a* shows the connector bodies 10 and 12 longitudinally aligned with the forward plug portion of the connector body 12 slidably received in the forward socket portion 30 of the connector body 10. In this position, the rounded surfaces 38 of latch arms 30 merely abut the forward cam surfaces 64 of the locking ramps 62 and the male blade terminals 22 are spaced longitudinally from the female terminals 54.

As the connector bodies 10 and 12 are moved longitudinally toward each other, the latch arms 30 are deflected outwardly by the lock ramps producing a force resisting mating of the connector bodies 10 and 12. This resistance force increases from substantially zero (when the connector bodies 10 and 12 are in the position shown in FIG. 4*a*) to a maximum as the latch arms 30 are cammed to a maximum outward deflection (when the connector bodies 10 and 12 are in the position shown in FIG. 4*b*). The resistance force is represented by the solid line 80 in the graphs 5*a* and 5*b* wherein various forces encountered during assembly are plotted against the distance the connector bodies 10 and 12 travel relative to each other from the position shown in FIG. 4*a* to the position shown in FIG. 4*c*. The points *a*, *b* and *c* on the ordinate of the graphs shown in FIGS. 5*a* and 5*b* correspond respectively to the positions shown in FIGS. 4*a*, 4*b* and 4*c*.

In position *b* (shown in FIG. 4*b*), the resistance force 80 is at a maximum. The male blade terminals 22 are just touching the female terminals 60 and consequently the resistance force produced during mating engagement of the terminals 22 and 60 is substantially zero. From this point on, however, mating engagement of the terminals produce a substantially constant resistance force (essentially the friction of the blade terminal sliding between the fingers which are biased thereagainst) represented by the dashed line 82 in FIG. 5*a*. As the terminal resistance force 82 is initiated, the latch arms 30 concurrently produce a negative resistance force or assistance force which is represented by the solid line 84 in FIG. 5*a*. The force 84 decreases from a maximum positive value to substantially zero as the connector bodies 10 and 12 are moved from position *b* (shown in FIG. 4*b*) to position *c* (shown in FIG. 4*c*) whereat the connector bodies and terminals are fully mated and the connector bodies are locked together by engagement of the surfaces 40 and 68.

From FIG. 5*a* it should be noted that the maximum magnitude of the resistance force 80 has a value of about twice the magnitude of the terminal resistance force 82. This insures that once assembly has been started, the connector bodies 10 and 12 will either be completely assembled or not assembled at all. It should also be noted that since the maximum magnitude of the resistance force 80 occurs prior to the resistance force 82, the force required for assembly on the connector means is minimized.

In FIG. 5*b* the resultant of the connector body and terminal engagement resistance forces are plotted with the ordinate points *a*, *b* and *c* again representing the positions shown in FIGS. 4*a*, 4*b* and 4*c* respectively. As stated above, the terminals do not resist mating of the connector bodies 10 and 12 until point *b*, and consequently the entire resistance force is for all practical purposes that produced by the outward deflection of the latch arm 30. Immediately upon the latch arms 30 passing over the peak of the lock ramps 62, the latch arms 30 produce a positive force 84 assisting mating assembly while the terminals simultaneously produce a constant resistance force 82. From FIG. 5*a*, it should be noted that the maximum positive force of 84 at point *b* slightly exceeds the negative terminal resistance force 82 and consequently the resultant force R is positive for a short time. Thus the lock means may be designed to produce forces which assist connection at the inception of forces produced by the terminal engagement resisting connection.

We wish it to be understood that we do not desire to be limited to the exact details of construction shown and described, for obvious modifications will occur to a person skilled in the art.

What is claimed is:

1. Matable electrical connector means having lock means comprising a first connector body of moldable insulating material having a given number of first longitudinal open ended terminal receiving cavities, each of which has a first terminal retained therein having a forward female portion, a second connector body of moldable insulating material having a corresponding number of second longitudinal open ended terminal receiving cavities, each of which has a second terminal retained therein having a forward male portion, one of said first and second connector bodies having a forward portion engaging a forward portion of the other of said connector bodies when said connector bodies are in a mated position whereat said first and second cavities are longitudinally aligned and said male portion(s) is received by said female portion(s) and biasingly engaged by resilient portions thereof, said first and second terminals having a predetermined terminal engagement force resisting connection of said connector bodies produced by insertion of said male portion(s) in said female portion(s) during assembly, one of said first and second connector bodies having integral cantilevered latch arm means and the other of said first and second connector bodies having protruding generally triangular locking ramp means which cooperate to lock said connector bodies in said mated position, said latch arm means having free end portion means engaging said ramp means and being deflected outwardly thereby during assembly producing a maximum predetermined force resisting assembly of said connector bodies into said mated position, and said ramp means being profiled and located on said other connector body such that during assembly said maximum predetermined force occurs prior to biased engagement of said male portion(s) by said female portion(s) and is about twice as great as said predetermined terminal engagement force.

2. Matable electrical connector means having lock means comprising a first connector body of moldable insulating material having a given number of longitudinal open ended terminal receiving cavities each of which has a first terminal retained therein having a forward female portion, a second connector body of moldable insulating material having a corresponding number of longitudinal open ended terminal receiving cavities each of which has a second terminal retained therein having a forward male portion, one of said first and second connector bodies having a forward socket portion receiving a forward plug portion of the other of said connector bodies when in a mated position whereat said cavities are longitudinally aligned and each of said male portion(s) is received by a female portion and biasingly engaged by resilient portions thereof, said first and second terminals having a substantially constant predetermined frictional force resisting connection of said connector bodies produced by insertion of said male portion(s) into said female portion(s) during assembly, one of said first and second connector bodies having integral cantilevered latch arm means and the other of said first and second connector bodies having protruding generally triangular shaped locking ramp means which cooperate to retain said connector bodies in said mated position, said latch arm means having free end portion means engaging said ramp means and being deflected outwardly thereby during assembly producing a maximum predetermined force resisting assembly of said connector bodies into said mated position which is about twice as great as said predetermined terminal engagement force, and said triangular ramp means having peak means between leading outwardly and rearwardly sloped portion means and inwardly and rearwardly sloped portion means, said peak means being located on said other connector body such that during assembly, said free end portion means of said latch arm means engages said peak means simultaneously with initial engagement of said male portion(s) with said female portion(s) whereby said maximum predetermined force resisting assembly occurs prior to commencement of said predetermined terminal engagement force.

3. Matable electrical connector means having lock means comprising a first connector body of moldable insulating material having terminal receiving cavity means in which first terminal means having forward female means is retained, a second connector body of moldable insulating material having terminal receiving cavity means in which second terminal means having forward male means is retained, one of said first and second connector bodies having a forward portion engaging a forward portion of the other of said connector bodies when said connector bodies are in a mated position whereat said first and second cavities are in communication and said forward male means is received by said forward female means and biasingly engaged by resilient portions thereof, said first and second terminal means having a predetermined terminal engagement force resisting connection of said connector bodies produced by insertion of said forward male means in said forward female means during assembly, one of said first and second connector bodies having integral deflectable portion means and the other of said first and second connector bodies having protruding portion means which cooperate to lock said connector bodies in said mated position, said deflectable portion means engaging cam surface means of said protruding portion means and being deflected thereby during assembly producing a resistance force resisting assembly of said connector bodies into said mated position, and said protruding portion means being located on said other connector body and said cam surface means being profiled such that during assembly the resistance force produced by said deflectable portion means reaches a maximum value prior to biased engagement of said forward male means by said forward female means producing said predetermined terminal engagement force resisting connection of said connector bodies, said maximum value being about twice as great as said predetermined terminal engagement force.

4. The matable electrical connector means as defined in claim 3 wherein said cam surface means are profiled such that said deflectable portion means produce an assistance force assisting assembly subsequent to the resistance force produced thereby reaching a maximum value, which assistance force commences at least as soon as said predetermined terminal engagement force.

5. The matable electrical connector means as defined in claim 4 wherein said assistance force produced by said deflectable portion means commences substantially simultaneously with said predetermined terminal engagement force and counteracts such with a greater force at least initially.

* * * * *